US006304227B1

(12) United States Patent
Hill et al.

(10) Patent No.: US 6,304,227 B1
(45) **Date of Patent: *Oct. 16, 2001**

(54) SLOT ANTENNA

(75) Inventors: Robert J. Hill, Fremont; David L. Thomas, San Jose, both of CA (US)

(73) Assignee: Schlumberger Resource Management Services, Inc., Norcross, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/929,161

(22) Filed: Sep. 12, 1997

(51) Int. Cl.[7] ..... H01Q 13/12
(52) U.S. Cl. ..... 343/769
(58) Field of Search ..... 343/769, 742, 343/741; H01Q 13/12

(56) References Cited

U.S. PATENT DOCUMENTS 2,501,430 * 3/1950 Alford ..... 343/741
2,611,865 * 9/1952 Alford ..... 343/769
5,155,493 * 10/1992 Thursby et al. ..... 343/700 MS
5,202,697 * 4/1993 Bonebright et al. ..... 343/770
5,621,419 * 4/1997 Meek et al. ..... 343/770
5,917,454 * 6/1999 Hill et al. ..... 343/769

FOREIGN PATENT DOCUMENTS 2 291 272 A 1/1996 (GB) .

* cited by examiner

*Primary Examiner*—Michael C. Wimer
(74) *Attorney, Agent, or Firm*—Fish & Richardson P.C.

(57) ABSTRACT

In one embodiment, an antenna has two annular conductive elements separated by a slot, and a third conductive element connecting the annular conductive elements together at at least one end of the slot. In another embodiment, an antenna has two generally parallel conductive elements of different heights separated by a slot, and a third conductive element connecting the conductive members together at at least one end of the slot.

24 Claims, 3 Drawing Sheets

SLOT ANTENNA

BACKGROUND

The invention relates to a slot antenna.

Wireless radio systems are used in remote metering (e.g., utility metering) applications in which electronic components must be placed in spaces not originally designed for such components. In water metering applications, for example, a transceiver and an antenna typically must fit within a small underground housing originally intended only for a mechanical water meter. In such an application, antenna performance is impeded because the antenna must transmit through the walls and lid of the underground housing and through the ground itself.

SUMMARY

In one aspect, the invention features an antenna having two annular conductive elements separated by a slot, and a third conductive element connecting the annular conductive elements together at at least one end of the slot. In some embodiments the conductive elements may be of similar diameters; they may be of different heights; they may consist of conductive tape or conductive wire; they may be less than two inches in diameter. The antenna also may include a dielectric insulator, and it may include a feed point to which a feed element may connect. The antenna also may be less than 0.5" in total height.

In another aspect, the invention features an antenna having two generally parallel conductive elements of different heights separated by a slot, and a third conductive element connecting the conductive members together at at least one end of the slot. In some embodiments, the generally parallel conductive members may extend along a dielectric material; and the third conductive element may connect the generally parallel conductive elements together at two ends of the slot.

In other aspects, the invention features methods of making an antenna. One method includes providing a generally straight slot antenna, and securing two ends of the generally straight slot antenna to form an annular slot structure. Another method includes positioning two annular conductive elements to form a slot between them, and connecting a third conductive element to each of the annular conductive elements to form at least one end of the slot. Another method includes positioning two conductive elements of similar lengths and of different widths to form a slot between them, and connecting a third conductive element between the other two conductive elements to form at least one end of the slot. Still another method includes providing a stamp having two annular conductive elements in the same plane connected together by a third conductive element, and bending the stamp so that the two annular conductive elements are no longer in the same plane but are essentially parallel to each other.

In another aspect, the invention features a stamp for use in forming an antenna. The stamp includes two annular conductive elements connected by a third conductive element, all three of which lie in substantially the same plane.

Advantages of the invention may include one or more of the following. An antenna may be made small enough to fit entirely or partially within a pre-drilled hole formed in a standard underground housing lid. The antenna also may be housed within a protective structure that passes through such a pre-drilled hole and that positions the antenna above the ground.

Vertical polarization of an antenna may be achieved with a very small vertical dimension (e.g., 0.5" or less). A simple slot structure may be used to create an antenna having an omnidirectional radiation pattern. The conductors used to form the slot structure may have different heights (an "offset slot" structure), which allows, e.g., more clearance between the radiating slot and an underground housing lid. Furthermore, the antenna may be fed at a position offset from the center of the slot, which provides a simple way to match the input impedance of the antenna with the characteristic impedance of the conductor feeding the antenna. The antenna may include a dielectric other than air to reduce the wavelength of a transmitted or received signal in the antenna, which in turn allows, e.g., reduction of the slot length and therefore the antenna's overall dimensions.

The antenna may be fabricated easily and inexpensively from, e.g., a conventional straight slot antenna, a die-cut stamp, or conductive wires or strips.

Other advantages of the invention will become apparent from the following description and from the claims.

DETAILED DESCRIPTION

Figure 1:
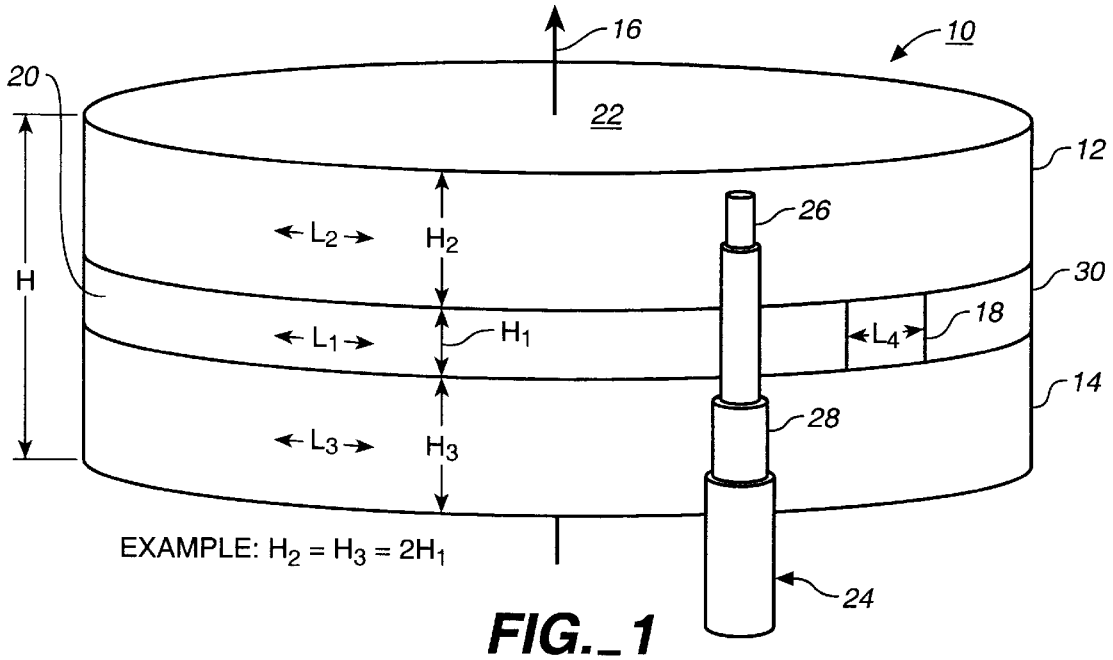
FIG. 1 is perspective view of a vertically-polarized, omnidirectional antenna.

Referring to FIG. 1, a vertically-polarized, omnidirectional slot antenna 10 consists of two annular (or ring-shaped) conductors 12, 14 centered along a common longitudinal axis 16 and joined by a conductive shorting post 18. The annular conductors are separated by a slot 20, the circumferential dimension $L_1$("length") of which equals the length $L_2$, $L_3$ (circumference) of each annular conductor 12, 14 less the length $L_4$ of the conductive shorting post 18. The vertical dimension $H_1$ ("height") of the slot 20 defines the distance separating the annular conductors 12, 14. The annular conductors 12, 14 and the conductive shorting post 18 may consist of virtually any conductive material, but highly conductive metals, such as copper, silver, or aluminum, are especially suited for use in the antenna 10. The annular conductors 12, 14 may be conductive strips with height dimensions $H_2$, $H_3$, as shown in FIG. 1, but other structures, such as conductive wires, also may be used.

The antenna is driven by signals from a bipolar signal feed element 24, such as a coaxial cable or a balanced two-wire line, the conductors 26, 28 of which each connect to one of the annular conductors 12, 14. Because the conductors 26, 28 of the signal feed element 24 connect across the slot 20, the annular conductors 12, 14 are driven at opposite polarities, creating a vertically-polarized electric field. Unlike a standard center-fed slot antenna (i.e., an antenna fed at a position equidistant from the slot's ends), antenna 10 may be fed at any point along the length $L_1$ of the slot 20 (i.e., the signal feed element 24 may be connected at any point along the periphery of the annular conductors).

Typically, the position of the signal feed element 24 is selected so that the input impedance of the antenna 10, as seen by the signal feed element 24, matches the characteristic impedance of the feed element 24. The antenna's input impedance is approximately zero if the feed element 24 is connected at the shorting post 18 and increases as the feed position moves away from the shorting post 18 toward the center of the slot 20. When a typical fifty ohm coaxial cable is used as the feed element 24, the feed position is selected to yield an input impedance of 50+j0 ohms. In practice, the appropriate feed position for a particular antenna may be determined by measuring continuously the antenna's input impedance as the position of the feed element 24 is varied.

The annular conductors 12, 14 typically wrap around a cylindrically-shaped dielectric insulator 22. In general, any dielectric material may be used, including inexpensive materials such as Styrofoam®, Teflon®, or plastics having relatively low dielectric losses. In some applications, air may serve as the dielectric, eliminating the need for the insulator 22, in which case a non-conductive support member could be positioned opposite the shorting post 18 to support the annular conductors 12, 14.

The diameter of the dielectric insulator 22, and therefore the lengths of the annular conductors 12, 14 and the slot 20, are determined by several factors, including the frequency at which the antenna 10 is to operate and the dielectric constant (K) of the insulator 22. In general, the length $L_1$ of the slot 20 should be less than but approximately equal to ½-wavelength in the dielectric at the desired frequency of operation, which allows the antenna 10 to operate with no phase reversals in the RF currents created in the antenna 10. The exact length of the slot 20 is determined by adjusting its length until the antenna is near resonance at the desired operating frequency. Since the wavelength of a transmitted or received signal in the antenna 10 is inversely proportional to the square-root of the effective dielectric constant of the insulator 22 and surrounding air, the diameter of the insulator 22 declines as the dielectric constant of the material increases.

The height H of the antenna is limited only by the spacial constraints of the application in which it is to be used and by the minimum heights of the annular conductors 12, 14 and the slot 20 required for proper operation. The antenna 10 therefore is vertically-polarized with a very small minimum vertical dimension, and because the antenna 10 is annular and has no phase reversals in the RF currents, its radiation pattern is omnidirectional (i.e., the antenna radiates a full 360° around the longitudinal axis 16).

The annular conductors 12, 14 and the shorting post 18 may be fastened to the dielectric insulator 22 in many ways. For example, the annular conductors 12, 14 and the shorting post 18 may consist of a conductive strip with an adhesive backing (e.g., copper tape) that adheres to the dielectric insulator 22. A conductive material, such as a metallic wire or solder connection, may be used to bridge any gaps that may exist between the shorting post 18 and either of the annular conductors 12, 14. Alternatively, the annular conductors 12, 14 and the shorting post 18 may be set into grooves formed in the outer surface 30 of the dielectric insulator 22.

Figure 2:
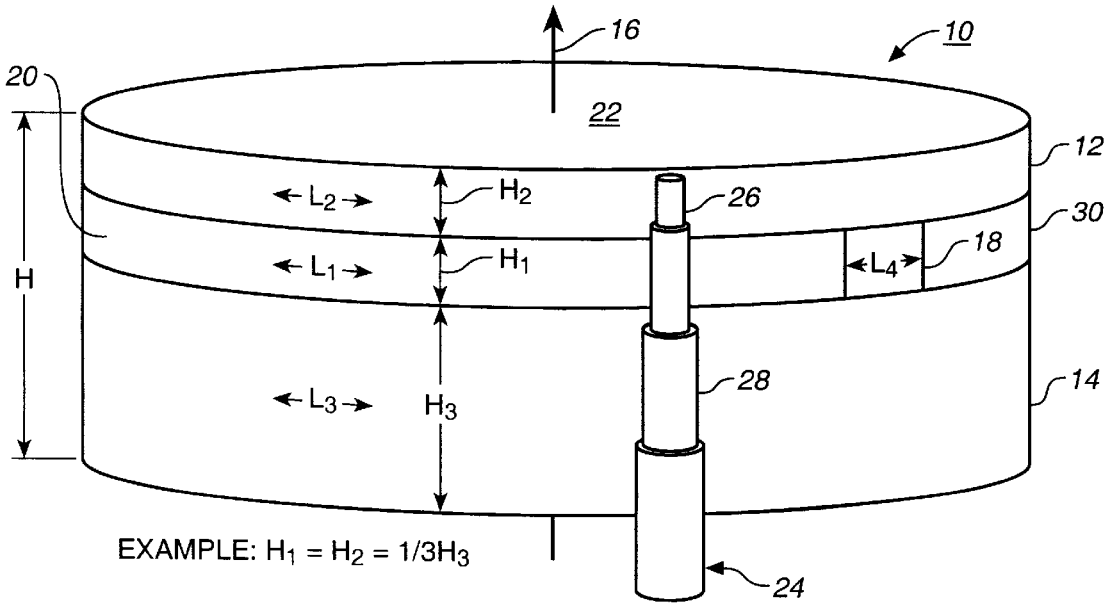
FIG. 2 is a perspective view of an alternative configuration of a vertically-polarized, omnidirectional antenna.

In FIG. 1, the annular conductors 12, 14 are of approximately equal height and have height dimensions $H_2$ and $H_3$ that are approximately twice as large as the height dimension $H_1$ of the slot 20. This configuration produces a radiation pattern that travels in a direction generally perpendicular to the longitudinal axis 16 of the antenna and that is centered at the middle of the antenna's overall height dimension H. Referring also to FIG. 2, the height dimension $H_3$ of the lower conductor 14 may be greater than that of ($H_2$) of the upper conductor 12. This places the slot 20 nearer the top of the antenna 10, which in turn causes the antenna 10 to radiate energy at points higher than those emitting energy in the configuration of FIG. 1. The configuration of FIG. 2 is useful, e.g., when the antenna 10 is to operate close to the ground, such as in the underground metering application described below.

Figure 3:
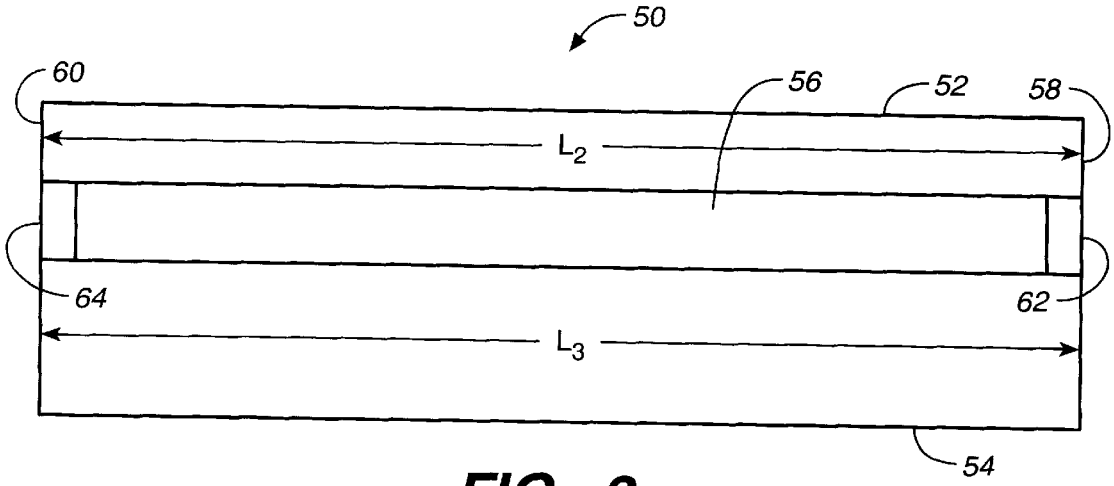
FIG. 3 is a view of a straight slot antenna that may be used to form a vertically-polarized, omnidirectional antenna.

Referring to FIG. 3, an annular slot antenna may be formed from a straight slot antenna 50 having two conductors 52, 54 of similar lengths $L_2$, $L_3$. The conductors are separated by a slot 56 and connected at their ends 58, 60 by shorting posts 62, 64. An annular slot antenna is formed by bending the straight slot antenna 50 until its ends 58, 60 meet and then securing (e.g., soldering) the ends 58, 60 together. When the ends 58, 60 are connected, the shorting posts 62, 64 join to form a single shorting post like that shown in FIG. 1 and FIG. 2. The straight slot antenna 50 may or may not be wrapped around a dielectric insulator.

Figure 4A:
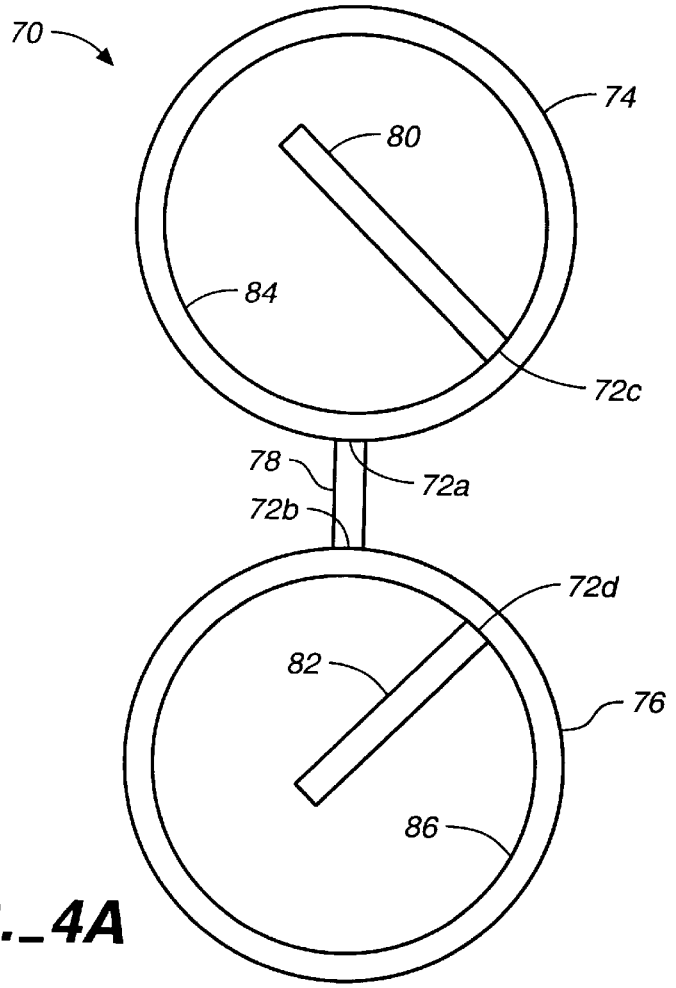
FIGS. 4A and 4B are views of a die-cut stamp that may be used to form a vertically-polarized, omnidirectional antenna.
Figure 4B:
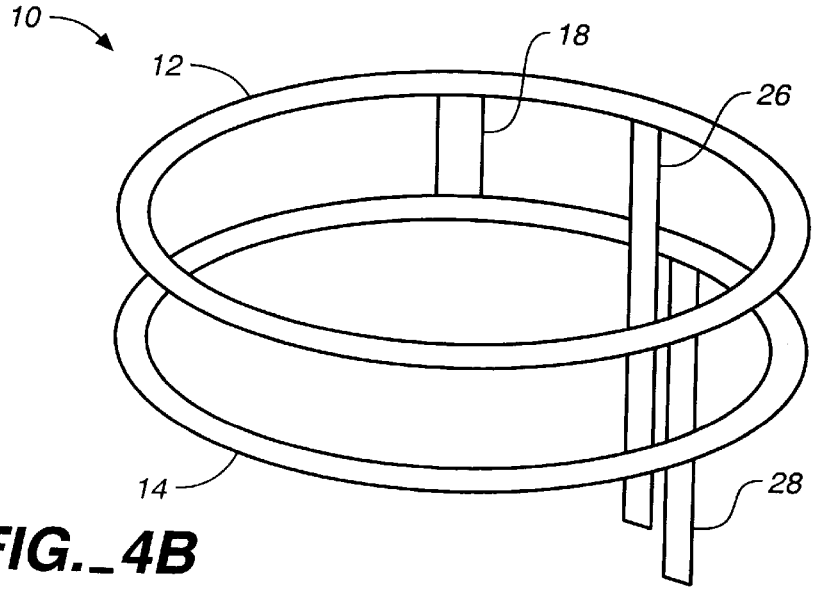

Referring to FIGS. 4A and 4B, the antenna also may be formed from a die-cut stamp 70 created from a conductive (e.g., aluminum) sheet. The stamp 70 includes two annular sections 74, 76 connected together by a conductive post 78. The annular sections 74, 76 intersect the post 78 at two "bend points" 72*a*, 72*b*, respectively. Two conductive stems 80, 82 extend from the inner surfaces 84, 86 of the annular sections, intersecting the annular sections at two additional "bend points" 72*c*, 72*d*, respectively. The die-cut stamp 70 is inexpensive and easy to create in mass production.

To form the antenna 10, the stamp 70 is bent by 90 degrees at each of the four bend points 72*a–d*. Each of the annular sections 74, 76 of the stamp 70 forms one of the annular conductors 12, 14 of the antenna 10, and the conductive post 78 forms the antenna's shorting post 18. Likewise, the two conductive stems 80, 82 form the conductors 26, 28 of the signal feed element. A non-conductive support (not shown) may be placed between the annular conductors 12, 14 to preserve the shape and dimensions of the antenna 10. Also, a dielectric insulator (not shown here) may be placed within and/or between the annular conductors 12, 14.

Figure 5:
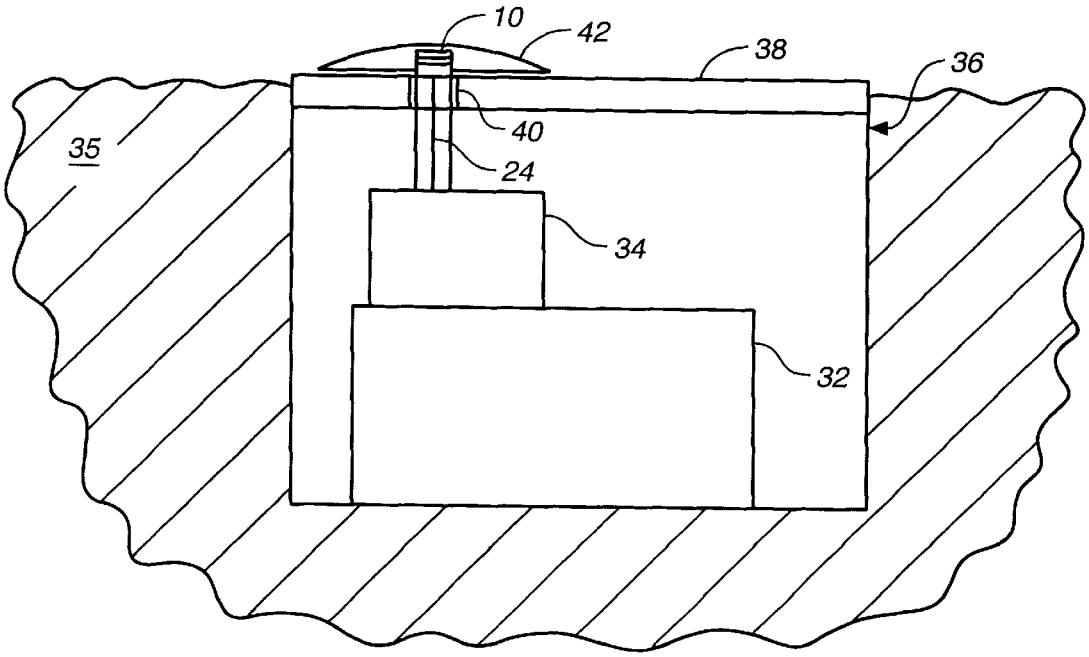
FIG. 5 is a schematic view of a vertically-polarized, omnidirectional antenna connected to a radio transceiver in an underground water meter.

Referring now to FIG. 5, a vertically-polarized, omnidirectional slot antenna 10 is suited for use in remote metering applications in which an underground device, such as a water meter 32, must exchange information over a wireless channel with a control center (not shown). In a typical situation, the water meter 32 and an electronic transceiver 34 are located underground 35 in a housing 36 covered by a lid 38, which typically is made from metal, fiberglass, or some other rigid and durable material. The antenna 10 is positioned either within or just above a standard sized hole 40 (usually less than two inches, and often approximately 1¾", in diameter) formed in the lid 38. A protective housing 42 made, e.g., of durable plastic protects the antenna 10 and secures it to the lid 38.

In operation, the antenna 10 transmits signals provided to it by the transceiver 34 and receives signals transmitted by the control center at an assigned frequency, e.g., a frequency in the "Industrial, Scientific, and Medical" (ISM) band (902 MHZ to 928 MHZ). For a typical antenna operating, e.g., at 920 MHZ ($\lambda_{air}$ =12.8") and having an effective dielectric constant of about two, the length of the slot is approximately 4.5", which is approximately ½-wavelength at the effective dielectric constant. The diameter of the antenna is about 1.5", which allows the antenna to fit into a structure passing through the 1¾" hole formed in the housing lid. The height of the antenna 10 in such an application typically is less than 1.0" and often will be 0.5" or less. The height dimension of the lower conductor typically is two to three times greater than the height dimensions of the slot and the upper conductor.

Other embodiments of the invention are within the scope of the following claims. For example, the annular conductors may take on any one of numerous shapes, including circular, ovular, hexagonal, etc. Also, the antenna may, in some applications, be mounted within the underground housing, e.g., to the underside of the housing lid. Furthermore, the antenna may be used in a wide variety of applications other than the underground metering application described above.

What is claimed is:

1. An antenna for use at or near a particular operational frequency comprising:

two cylindrical conductive elements separated by a slot having a circumferential length equal to approximately ½-wavelength at the operational frequency, one of the conductive elements being located nearer the top of the antenna than the other with the height dimension of the lower conductive element being greater than that of the upper conductive element; and a third conductive element connecting the cylindrical conductive elements together at at least one end of the slot.

2. The antenna of claim 1, wherein the conductive elements are of similar diameters.

3. The antenna of claim 1, further comprising a dielectric material around which the annular conductive elements extend.

4. The antenna of claim 1, wherein at least one of the conductive elements comprises a strip of conductive tape.

5. The antenna of claim 1, wherein at least one of the conductive elements comprises a conductive wire.

6. The antenna of claim 1, further comprising a feed point to which a feed element connects to drive the antenna electrically.

7. The antenna of claim 6, wherein the feed point is positioned so that the feed element and the antenna are impedance-matched.

8. The antenna of claim 6, wherein the feed point is positioned closer to one end of the slot.

9. The antenna of claim 1, wherein the conductive elements each form an annulus no greater than approximately two inches in diameter.

10. The antenna of claim 1, wherein the conductive elements each form an annulus no greater than approximately 1.5 inches in diameter.

11. The antenna of claim 1, wherein the overall height of the antenna is no greater than approximately 0.5".

12. An antenna for use at or near a particular operational frequency comprising:

first and second substantially parallel cylindrical conductive elements of different height dimensions separated by a slot having a circumferential length equal to approximately ½-wavelength at the operational frequency; and a third conductive element connecting the first and the second conductive elements together at at least one end of the slot.

13. The antenna of claim 12, wherein the first and the second conductive elements are of similar lengths.

14. The antenna of claim 12, further comprising a dielectric material.

15. The antenna of claim 14, wherein the first and the second conductive elements extend along the dielectric material.

16. The antenna of claim 12, wherein at least one of the conductive elements comprises a strip of conductive tape.

17. The antenna of claim 12, wherein at least one of the conductive elements comprises a conductive wire.

18. The antenna of claim 12, wherein the third conductive element connects the first and the second conductive elements together at two ends of the slot.

19. The antenna of claim 12, further comprising a feed point to which a feed element connects to drive the antenna electrically.

20. The antenna of claim 19, wherein the feed point is positioned so that the feed element and the antenna are impedance-matched.

21. The antenna of claim 19, wherein the feed point is positioned closer to one end of the slot.

22. A method of making an antenna for use at or near a particular operational frequency, the method comprising:

positioning two cylindrical conductive elements to form a slot between them, where the slot has a circumferential length equal to approximately ½-wavelength at the operational frequency;

positioning one of the conductive elements nearer the top of the antenna than the other with the height dimension of the upper conductive element being less than that of the lower conductive element; and connecting a third conductive element to each of the cylindrical conductive elements to form at least one end of the slot.

23. The method of claim 22, further comprising extending the conductive elements around a dielectric insulator.

24. A method of making an antenna, the method comprising:

positioning first and second cylindrical conductive elements of similar circumferential lengths and of different height dimensions to form a slot between them; and connecting a third conductive element between the first and second conductive elements to form at least one end of the slot.

* * * * *